US007152532B2

(12) United States Patent
Conrad

(10) Patent No.: US 7,152,532 B2
(45) Date of Patent: Dec. 26, 2006

(54) PROJECTILE WITH A SUB-CALIBER PENETRATOR CORE

(75) Inventor: Markus Marcellus Conrad, Thun (CH)

(73) Assignee: Ruag Land Systems, Warhead Division, Thun (CH)

( * ) Notice: Subject to any disclaimer, the term of this patent is extended or adjusted under 35 U.S.C. 154(b) by 0 days.

(21) Appl. No.: 11/233,969

(22) Filed: Sep. 23, 2005

(65) Prior Publication Data

US 2006/0260501 A1 Nov. 23, 2006

Related U.S. Application Data

(63) Continuation of application No. PCT/IB03/01139, filed on Mar. 25, 2003.

(51) Int. Cl.
*F42B 12/02* (2006.01)

(52) U.S. Cl. ..... 102/473; 102/489

(58) Field of Classification Search ..... 102/489, 102/473, 475, 476, 499, 500, 216
See application file for complete search history.

(56) References Cited

U.S. PATENT DOCUMENTS

| | | | |
|---|---|---|---|
| 2,873,677 | A | 2/1959 | Taylor et al. |
| 4,567,830 | A | 2/1986 | Apotheloz |
| 5,148,750 | A | 9/1992 | Becker et al. |
| 6,186,072 | B1 | 2/2001 | Hickerson, Jr. et al. |
| 6,276,277 | B1 | 8/2001 | Schmacker |
| 6,672,218 | B1 | 1/2004 | Oechslin et al. |

*Primary Examiner*—Michael J. Carone
*Assistant Examiner*—Gabriel J. Klein
(74) *Attorney, Agent, or Firm*—Schweitzer Cornman Gross & Bondell LLP

(57) ABSTRACT

A low-speed projectile is designed for forming relatively large apertures in walls against which the projectile is fired. The projectile includes a penetrator core having a cavity containing an explosive charge activated by a time delay fuse circuit. The time delay is chosen to cause explosive ignition when the cavity and explosive is within the wall to be pierced. The construction of the projectile directs the explosive impulse radially, creating a hole in the wall considerably larger than the outside diameter of the penetrator's core. A preferred application is a projectile for a shoulder-fired weapon.

5 Claims, 1 Drawing Sheet

PROJECTILE WITH A SUB-CALIBER PENETRATOR CORE

FIELD AND BACKGROUND OF THE INVENTION

The present application is a continuation of PCT/IB03/01139, filed 25 Mar. 2003, and relates to a projectile with an impact speed below 600 m/s, the projectile comprising a sub-caliber penetrator core. A projectile of this general type is known from U.S. Pat. No. 6,672,218 (hereinafter referred to as "U.S. '218"), the teachings of which are incorporated herein by reference. The projectile has an outer shell corresponding in its outside dimensions to a conventional bazooka shaped charge warhead. The projectile can therefore be fired by conventional bazooka rocket weapon launch equipment. In contrast to a conventional bazooka warhead, the projectile according to U.S. '218 comprises a relatively massive penetrator core of reduced diameter which can pierce brick or concrete walls, sand bag shielding or light armor plates. The penetrator core has a cavity which may contain a non-lethal active substance which is spread into the space behind the target wall pierced by the penetrator core by igniting a relatively small explosive charge. To that end, the charge's fuse, activated by an impact sensor, is fired with a time delay in the order of about one second.

A fuse that is suitable for that purpose is disclosed in U.S. Pat. No. 5,269,223. The fuse comprises a locking and safety mechanism that enables firing of a main charge only after the projectile is a safe distance away from its launch site and before five seconds have lapsed. If within that time span an impact sensor emits a signal of sufficient magnitude the main charge is fired with a time delay.

While projectiles of the type set forth in U.S. '218 are able to penetrate a wall for the purpose of releasing an active substance beyond the wall, the wall cavity produced by the projectile is rather small, and thus may be of limited value in providing an entranceway through the wall for the further passage of projectiles; equipment or personnel.

It is accordingly a purpose of the present invention to provide a projectile having the general configuration of a projectile of the type disclosed in U.S. '218 but capable of substantially increased destruction of a wall to be penetrated.

SUMMARY OF THE INVENTION

In accordance with the foregoing, the present invention aims at increasing the efficiency of the projectile at the target. This aim is achieved according to the invention by a projectile with an impact speed below 600 m/s. The projectile comprises a sub-caliber penetrator core with a cavity containing an explosive charge and a fuse. The fuse has a time delay circuit. The time delay adjusted in the time delay circuit is set such that the explosive charge is fired while the penetrator core is within a wall or other barrier to be penetrated or pierced.

Whereas the penetrator core according to U.S. Pat. No. 6,672,218 only creates a small diameter hole in the penetrated wall corresponding to the diameter of the penetrator core, the projectile according to the present invention creates a substantially larger hole. In a test firing, a brick wall of 1 m×1 m and 37.5 cm thickness was completely crumbled. In reinforced concrete walls the effect is somewhat lessened.

The time delay may be set to between 0.8 ms and 3.4 ms, and preferably to about 1.7 ms, for a projectile velocity as it hits the target of about 100–600 m/s. This impact speed is well below the speed of sound in concrete, which is about 2,000 m/s in undamaged concrete and is reduced to roughly 800 m/s in somewhat fractured concrete. Due to this subsonic impact speed, the penetrator core is hardly damaged while piercing the target wall. The shock wave in the target wall created by the impact of the penetrator core moves ahead of the core and crumbles the wall material. The penetrator core slips through that material like through gravel or sand.

Preferably, the penetrator core comprises a massive metallic body both in front and behind the cavity. Thus, the hole in the target created by the penetrator core is dammed off on both sides as the explosive charge is fired. This substantially increases the effect of the explosion on the target. The fuse may be included in the rear metallic body.

BRIEF DESCRIPTION OF THE DRAWINGS

A preferred, but nonetheless illustrative, embodiment of the present invention is hereinafter described with reference to the annexed drawings, in which.

DETAILED DESCRIPTION OF THE INVENTION

Figure 1:
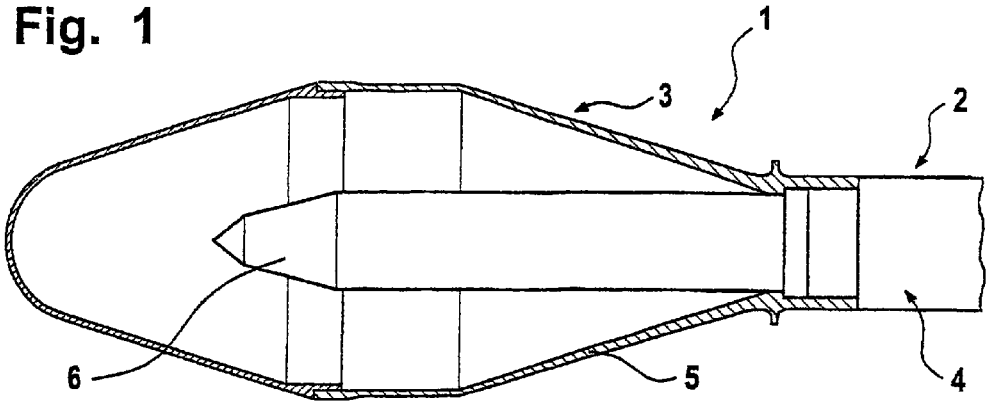
FIG. 1 is a longitudinal view of the front part of a projectile in accordance with the invention.

FIG. 1 shows the front part of a projectile 1. The projectile 1 comprises a rear part 2 and a forward part 3. The rear part 2 includes a propulsion unit 4 (rocket) and stabilizing fins at its rear end (not shown). These elements may be identical to the propulsion unit and stabilizer fins of other projectiles fired from commonly known weapons such as bazookas, missile launchers or mortars, so that the projectile 1 according to the present invention can be fired from such weapons.

The forward part 3 comprises a relatively thin walled aluminum shell 5 and a sub-caliber penetrator core 6 mounted in the shell 5. The shell 5 is mounted on the propulsion unit 4 in the same way that a standard or conventional shaped charge warhead of a bazooka is mounted on the propulsion unit 4. The outside dimensions of the shell 5 are the same as the ones of the standard warhead for that weapon. That way the gunner, who is trained to handle his, e.g., shoulder fired weapon against armoured targets like combat tanks, can readily also fire a projectile according to the present invention. The trajectory of the projectile is the same. The gunner only needs to differentiate between the two types of ammunition and to know the different safety instructions that may be associated therewith. The additional training for the soldiers is at most one day, and the costs for additional logistics are minimal.

Figure 2:
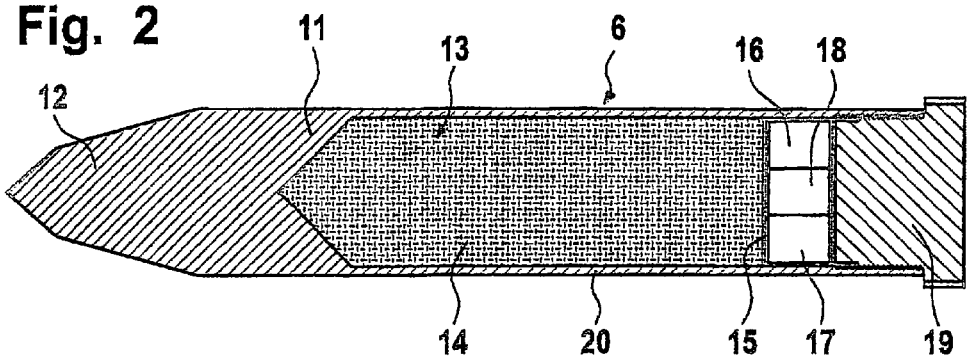
FIG. 2 is a longitudinal section view of a penetrator core of the invention.

FIG. 2 shows the penetrating core 6 of FIG. 1 in more detail. It comprises a shell 11 of a steel alloy, such as described in U.S. '218. Shell 11 also has a massive, solid front body 12 which has the purpose as described in U.S. '218, namely of penetrating or piercing a target, but, according to the present invention, also has a second purpose which it does not have in the projectile according to U.S. '218, and which will be further described herein. The outside geometry of the shell 11 and its composition may correspond to that of U.S. '218 with the advantages described therein.

The shell 11 has a cavity 13 filled with an explosive charge 14. In contrast to U.S. '218 this charge is not a non-lethal agent nor a charge adapted to eject fragments at high speed, but is an explosive charge 14 to create a high pressure impulse. The explosive charge 14 is fired by a fuse 15. The fuse 15 may be of the design described in U.S. Pat. No. 5,269,223 and comprises a locking and safety device and impact sensor 16, a time delay circuit 17 and a detonator cup 18 which ignites the explosive charge 14. In contrast to U.S. '218 the penetrator core 6 of the present invention further comprises a solid metallic body 19, solidly fixed to the rear end of the shell 11, behind or in front of the fuse 15, but in any case behind the explosive charge 14. The metallic body 19 may consist of or comprise the fuse 15. Its mass is roughly half the mass of the solid front body 12, may be of the same material, such as an alloyed quenched and tempered steel, as the solid front body 12.

Figure 3:
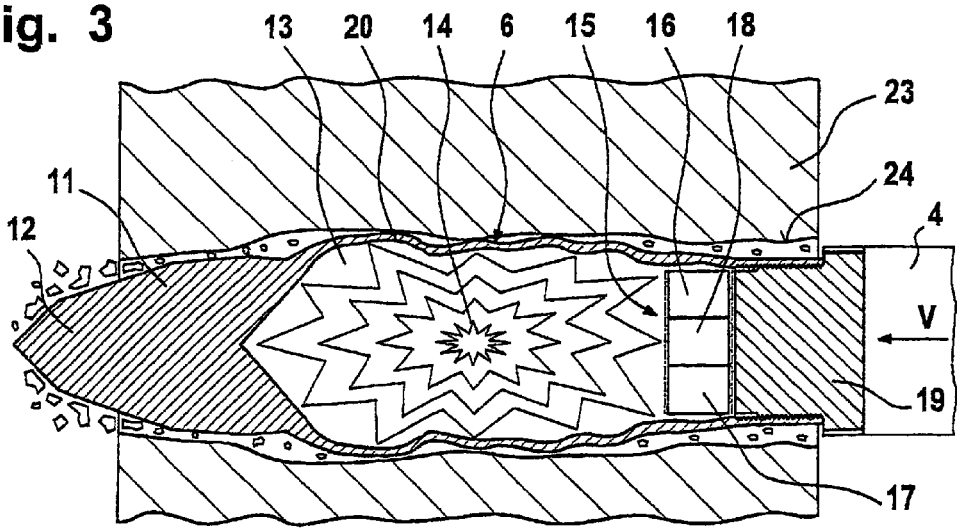
FIG. 3 is a diagrammatic view of an exploding penetrator core.

The effect of the projectile according to the present invention is schematically shown in FIG. 3. As the projectile 1 hits a target wall 23, e.g. of brick or concrete, the shell 5 of the forward part 3 (not shown) disintegrates. The penetrator core 6 hits the wall 23 with a speed V typically between 100 and 600 m/s. Upon contacting the wall the impact sensor 16 of the fuse 15 generates a signal which triggers the time delay circuit 17. The penetrator core 6 creates a roughly cylindrical hole 24 in the wall 23. The delay time set in the time delay circuit 17 is set at a value such that the detonator cup 18 is fired while the penetrator core 6 is still within the wall 24, i.e. while the hole 24 is plugged off at the forward end by the front body 12 and at the rear end by the metallic body 19. This results in an efficient damming of the explosive charge 14 as it is ignited by the detonator cup. This plugging action, in association with the relatively thin sidewall 20 of the charge cavity 13, allows the main effects of the explosion to be directed radially into the wall 23, creating a large size hole. To that end the time delay set in the time delay circuit is typically set between 0.8 ms and 3.4 ms, and preferably at about 1.7 ms.

The projectile according to the present invention has the great advantage that a large size hole can be produced in a wall, e.g. a man-sized hole can be produced in a brick wall, without much collateral damage. This can be important e.g. to arrest terrorists entrenched in a building.

For an easy-to-handle should fired weapon (e.g. a bazooka) the impact speed of the projectile is 150–300 m/s. In such an application the delay time will be set in the range of 1.2 to 2.4 ms. Those skilled in the art can readily determine appropriate delay times for other projectile types and corresponding impact speeds.

I claim:

1. A projectile with an impact speed below 600 m/s, the projectile comprising a sub-caliber penetrator core having a cavity containing an explosive charge; a first metallic body in front of the cavity and a second metallic body behind the cavity, the first and second metallic bodies having a mass ratio of about 2:1; and a fuse with a time delay device having a delay time between 0.8 and 3.4 ms such that the explosive charge is fired by the fuse while the penetrator core is within a wall to be pierced.

2. The projectile according to claim 1, wherein the delay time is about 1.7 ms.

3. The projectile according to claim 1, wherein the first and second metallic bodies are of the same material.

4. The projectile according to claim 1, wherein the projectile is for a shoulder-fired weapon, wherein the delay time is between 1.2 ms and 2.4 ms.

5. The projectile of claim 1, wherein the cavity has a sidewall and forward and rear wall portions constructed to direct a pressure impulse created by an ignition of the explosive charge primarily in a radial direction through the sidewall.

* * * * *